US010281194B2

(12) United States Patent
Choo et al.

(10) Patent No.: US 10,281,194 B2
(45) Date of Patent: May 7, 2019

(54) REFRIGERATOR

(71) Applicant: LG ELECTRONICS INC., Seoul (KR)

(72) Inventors: Ayoung Choo, Seoul (KR); Junghun Kim, Seoul (KR); Raeyoung Park, Seoul (KR); Jihyun Im, Seoul (KR); Jindong Kim, Seoul (KR); Hyunbum Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/898,368

(22) PCT Filed: Jun. 16, 2014

(86) PCT No.: PCT/KR2014/005249
§ 371 (c)(1),
(2) Date: Dec. 14, 2015

(87) PCT Pub. No.: WO2014/200316
PCT Pub. Date: Dec. 18, 2014

(65) Prior Publication Data

US 2016/0138855 A1 May 19, 2016

(30) Foreign Application Priority Data

Jun. 14, 2013 (KR) ..... 10-2013-0068184
Jun. 14, 2013 (KR) ..... 10-2013-0068234
Oct. 18, 2013 (KR) ..... 10-2013-0124732

(51) Int. Cl.
*F25D 23/04* (2006.01)
*F25D 23/02* (2006.01)
(Continued)

(52) U.S. Cl.
CPC ..... *F25D 23/04* (2013.01); *E05B 1/0038* (2013.01); *E05B 7/00* (2013.01); *E05B 47/06* (2013.01);
(Continued)

(58) Field of Classification Search
CPC ..... F25D 23/04; F25D 23/025; F25D 23/028; F25D 23/062; F25D 23/065;
(Continued)

(56) References Cited

U.S. PATENT DOCUMENTS 1,927,398 A * 9/1933 Glasser ..... F25D 23/04 292/DIG. 71
1,984,977 A * 12/1934 Mize ..... F25D 23/04 312/276
(Continued)

FOREIGN PATENT DOCUMENTS

DE 3205963 A1 9/1983
DE 3448057 A1 * 6/1986 ..... F24C 15/12
(Continued)

OTHER PUBLICATIONS

Extended European Search Report in European Application No. 14811416.8-1605/3008408, dated Feb. 2, 2017, 8 pages (with English translation).
(Continued)

*Primary Examiner* — Hanh V Tran
(74) *Attorney, Agent, or Firm* — Fish & Richardson P.C.

(57) ABSTRACT

Disclosed is a refrigerator. The refrigerator includes a cabinet (10) defining a first storage region (2) in which food is stored, a door (20) rotatably connected to a first rotating shaft (42), located at the front of the cabinet (10), via a first hinge member (40) to open or close the first storage region (2), a gasket (26) provided at the door (20), a container (100) defining a second storage region (52) received in the first
(Continued)

storage region (2), the container (100) being rotatably connected to a second rotating shaft, located at the door (20), via a second hinge member (200), a latch member installed to the container (100), and a fastening device (600) provided at the door (20), the fastening device (600) being caught by the latch member to selectively couple the door (20) and the container (100) to each other. The fastening device (600) includes a seal (626) configured to prevent outward movement of cold air through the fastening device (600) in a coupled state of the door (20) and the container (100).

21 Claims, 14 Drawing Sheets

(51) Int. Cl.

| | |
|---|---|
| ***E05B 47/06*** | (2006.01) |
| ***E05B 65/00*** | (2006.01) |
| ***E05C 3/30*** | (2006.01) |
| ***E05C 7/02*** | (2006.01) |
| ***E05B 1/00*** | (2006.01) |
| ***E05B 7/00*** | (2006.01) |
| ***F25D 23/06*** | (2006.01) |

(52) U.S. Cl.
CPC ..... *E05B 65/0042* (2013.01); *E05B 65/0046* (2013.01); *E05C 3/30* (2013.01); *E05C 7/02* (2013.01); *F25D 23/025* (2013.01); *F25D 23/028* (2013.01); *F25D 23/062* (2013.01); *F25D 23/065* (2013.01); *F25D 2201/10* (2013.01)

(58) Field of Classification Search
CPC ..... F25D 2201/10; E05B 7/00; E05B 7/02; E05B 47/06; E05B 65/0042; E05B 65/0046; E05B 1/0038; E05C 3/30
See application file for complete search history.

(56) References Cited

U.S. PATENT DOCUMENTS 2,046,909 A * 7/1936 Terry ..... F25D 23/04 312/292
2,051,132 A * 8/1936 Dart ..... F25D 23/04 126/340
2,122,680 A * 7/1938 Dart ..... F25D 23/04 126/197
2,129,923 A * 9/1938 Frankel ..... F25D 11/02 126/197
2,131,680 A * 9/1938 Zahodiakin ..... F25D 23/04 312/242
2,150,064 A * 3/1939 John ..... F25D 23/04 292/169
2,204,053 A * 6/1940 Dart ..... E05B 65/0042 292/5
2,243,772 A * 5/1941 Peltier ..... E05B 65/0046 126/197
2,287,446 A 6/1942 Parsons
2,942,438 A 6/1960 Schmeling
2,945,733 A * 7/1960 Malia ..... F25D 23/04 280/79.2
3,086,830 A * 4/1963 Malia ..... F25D 23/04 292/31
3,218,111 A * 11/1965 Steiner ..... F25D 23/04 312/292
4,203,622 A 5/1980 Cook
4,302,907 A * 12/1981 Canals ..... E05C 7/02 292/150
5,988,709 A * 11/1999 Lee ..... E05B 65/0042 292/199
8,147,015 B2 4/2012 Kim
8,844,983 B2 * 9/2014 Kang ..... F25D 23/04 292/194
9,353,984 B2 * 5/2016 Kim ..... F25D 23/028
2005/0200253 A1 * 9/2005 Wissinger ..... F25D 23/028 312/405
2006/0022563 A1 2/2006 Huruoka
2009/0007608 A1 * 1/2009 Lorek ..... E05B 63/18 70/144
2010/0308705 A1 * 12/2010 Kwon ..... F25D 23/025 312/404
2012/0062093 A1 * 3/2012 Lee ..... F25D 23/025 312/405
2012/0137722 A1 * 6/2012 Kim ..... F25D 23/028 62/440
2013/0026900 A1 * 1/2013 Oh ..... F25D 23/02 312/401
2013/0033163 A1 2/2013 Kang
2013/0049562 A1 * 2/2013 Jung ..... F25D 23/028 312/405
2015/0069900 A1 * 3/2015 Lim ..... F25D 23/028 312/405
2015/0137674 A1 * 5/2015 Choi ..... F25D 23/04 312/404
2015/0176886 A1 * 6/2015 Lee ..... E05C 7/02 312/404
2015/0241116 A1 * 8/2015 Choi ..... E05B 65/0042 312/404
2015/0260443 A1 * 9/2015 Lee ..... F25D 23/02 312/404
2016/0061511 A1 * 3/2016 Park ..... F25D 11/02 312/404

FOREIGN PATENT DOCUMENTS

EP 0 959 208 A1 11/1999
EP 2 565 565 A2 3/2013
JP S 50-84862 U 7/1975
JP S57-085184 * 5/1982
JP 2000249462 A * 9/2000 ..... F25D 23/025
JP 2004211977 A * 7/2004
JP 2013053843 A * 3/2013 ..... F25D 23/028
KR 1019970011756 * 3/1997
KR 1999-0042339 A * 6/1999
KR 20120063316 A * 6/2012
WO WO 2011081279 A1 * 7/2011 ..... F25D 23/02

OTHER PUBLICATIONS

International Search Report dated Nov. 12, 2014 for Application No. PCT I KR 2014/005249, 3 pages.

* cited by examiner

[Fig. 1]
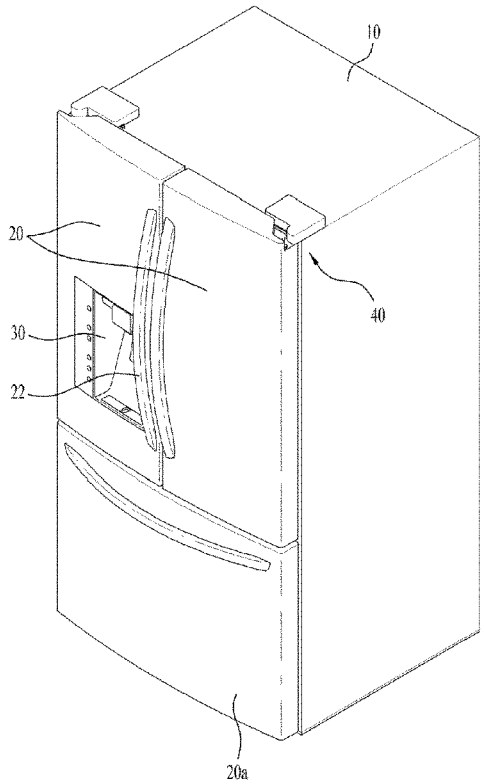
[Fig. 2]
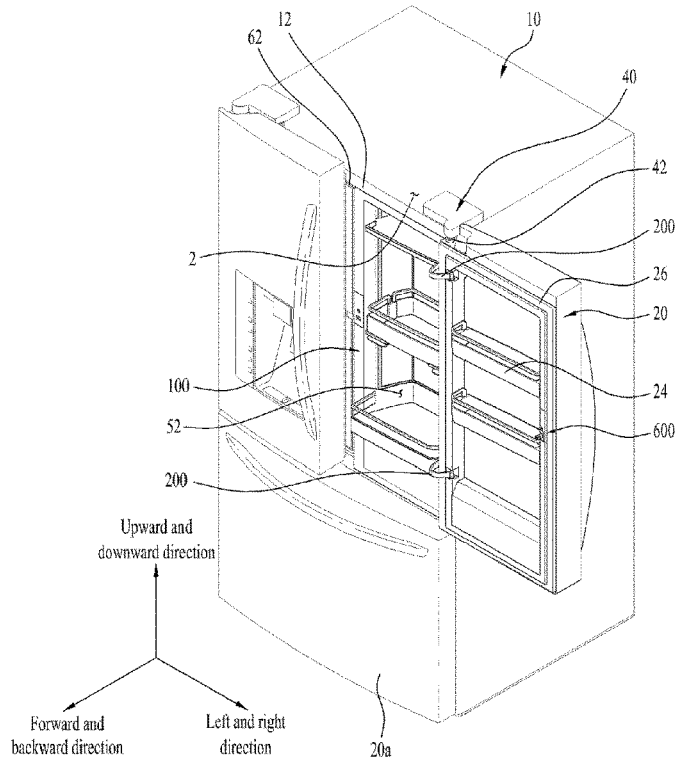

[Fig. 3]
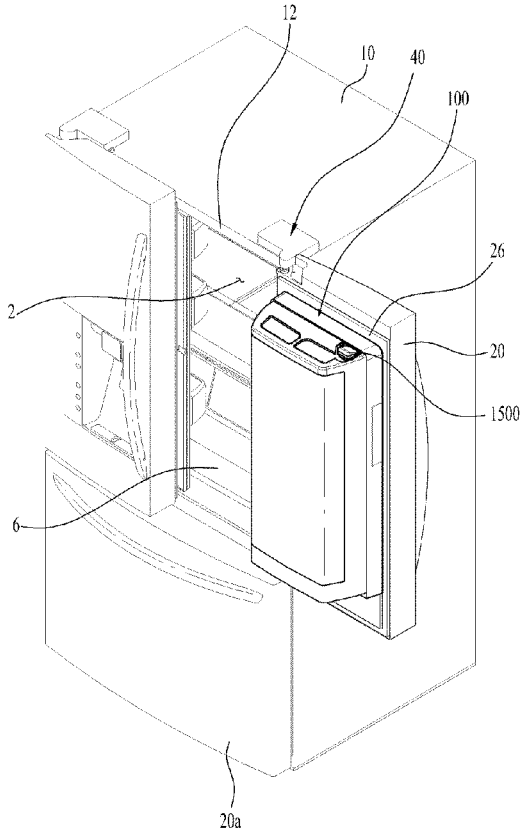
[Fig. 4]
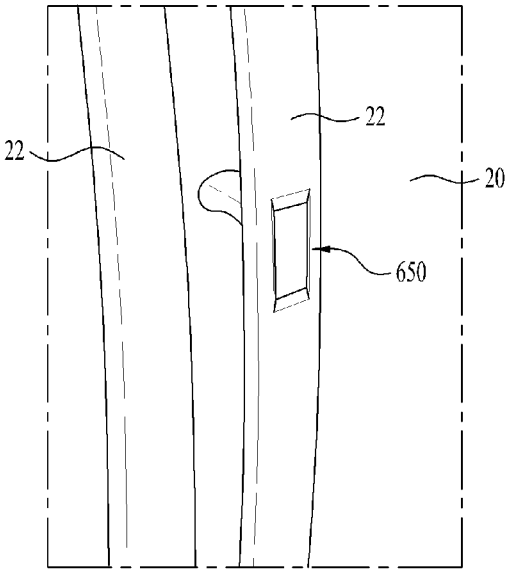

[Fig. 5]
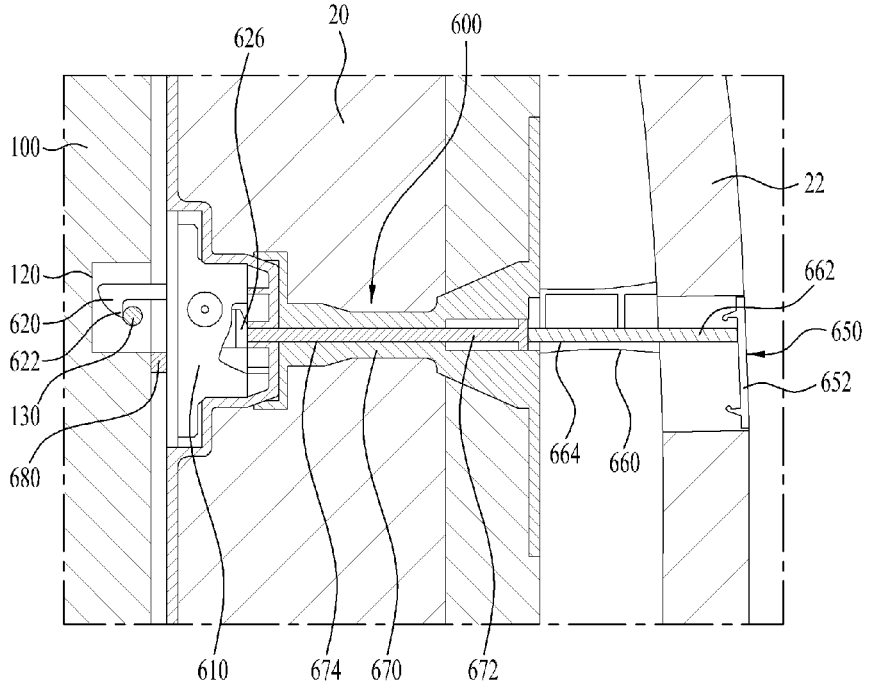
[Fig. 6]
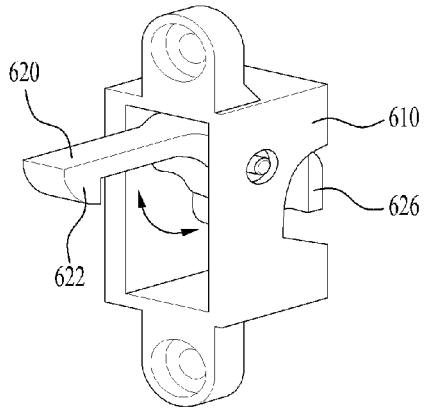

[Fig. 7]
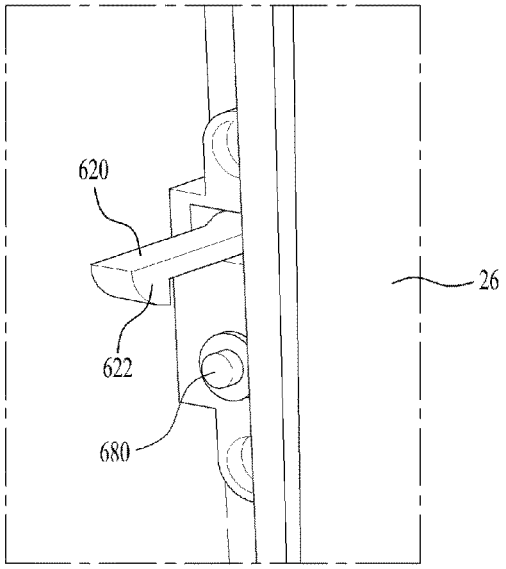
[Fig. 8]
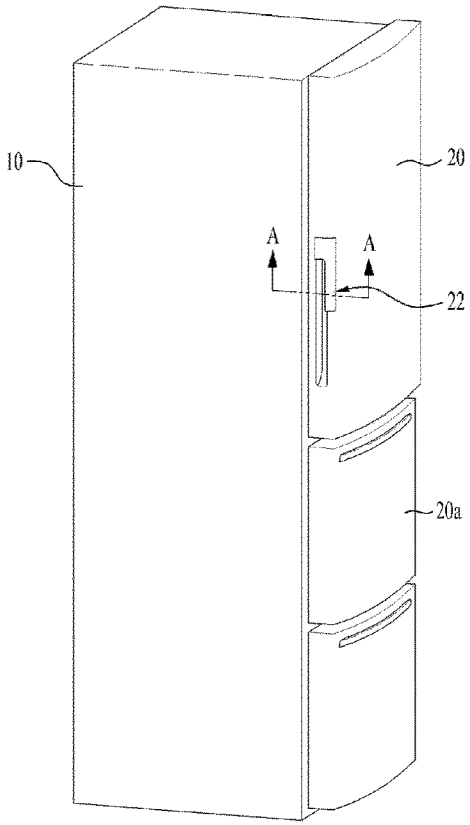

[Fig. 9]
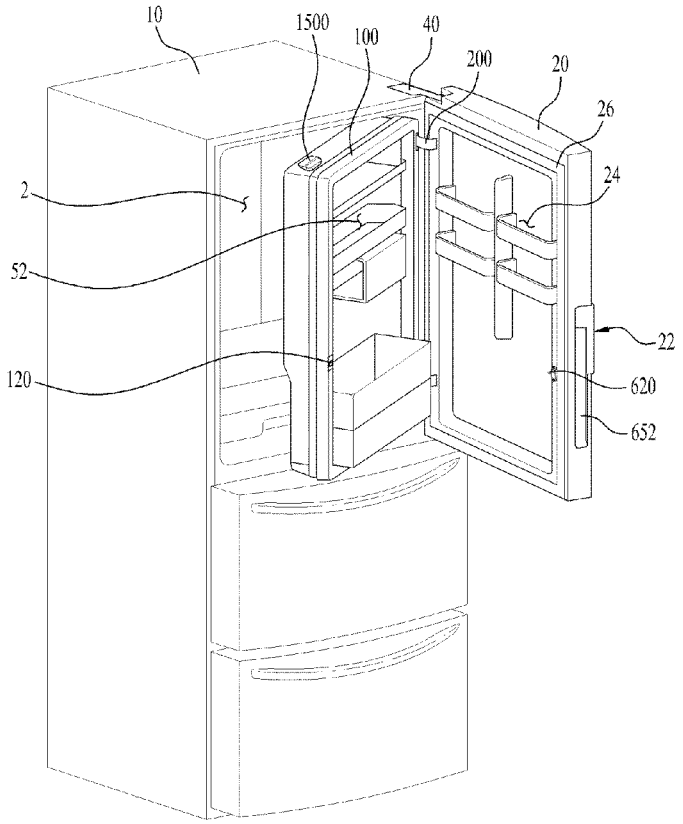
[Fig. 10]
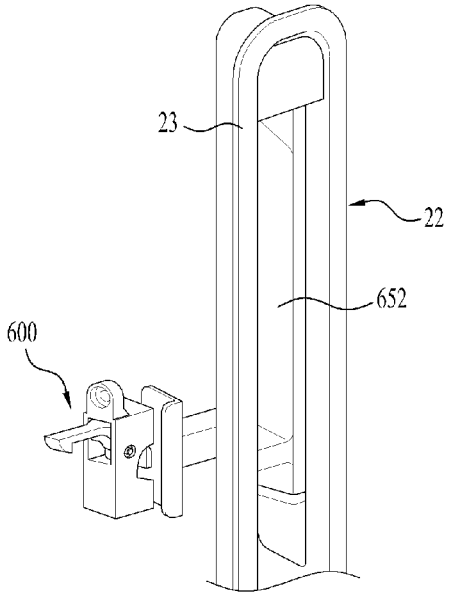

[Fig. 11]
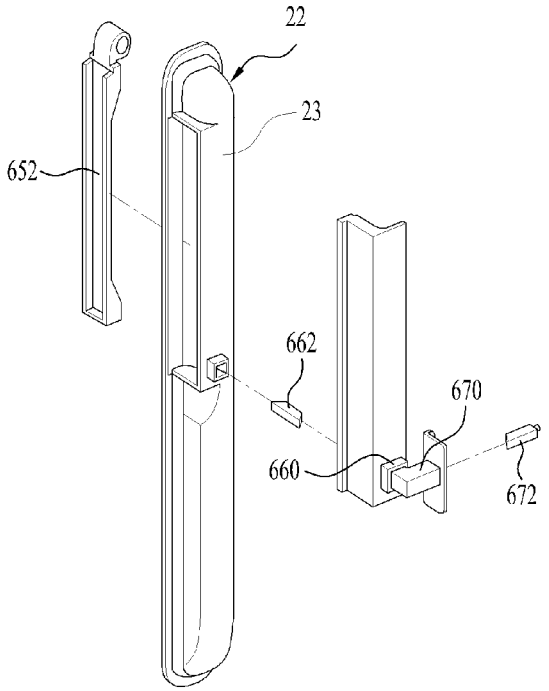
[Fig. 12]
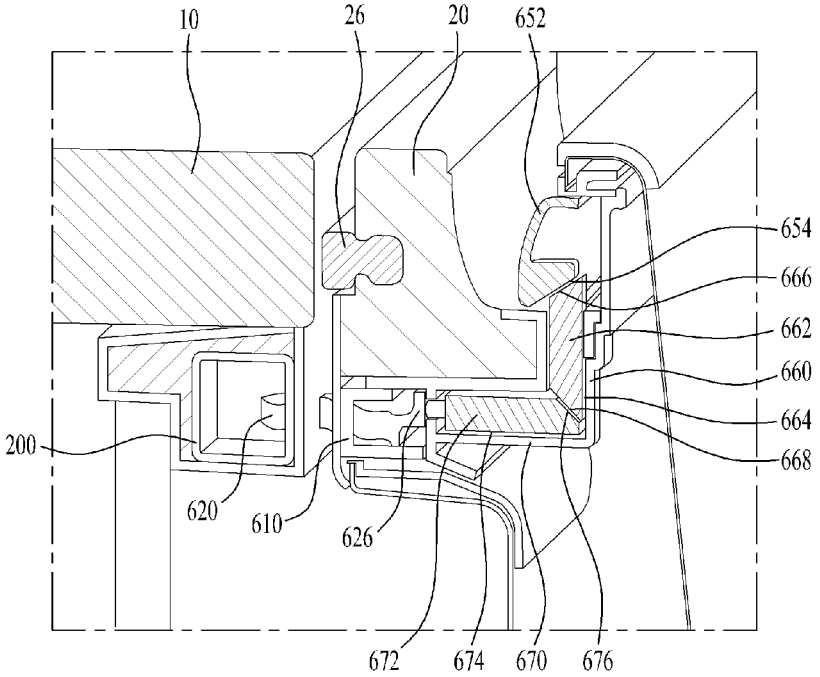

[Fig. 13]
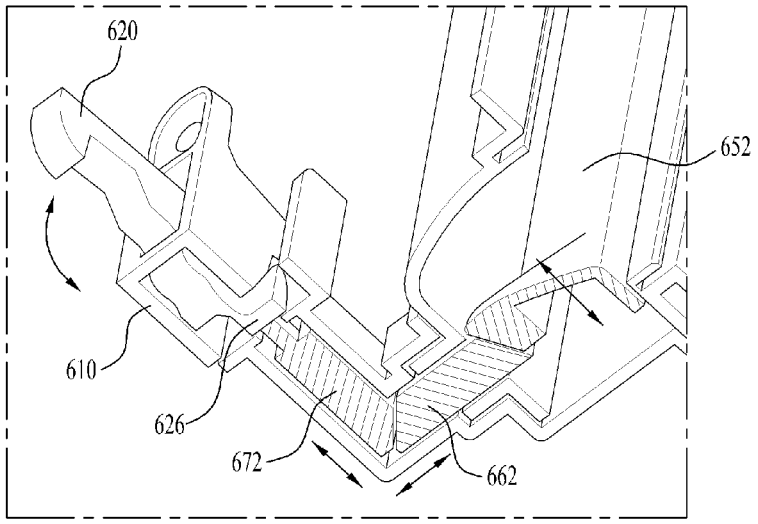
[Fig. 14]
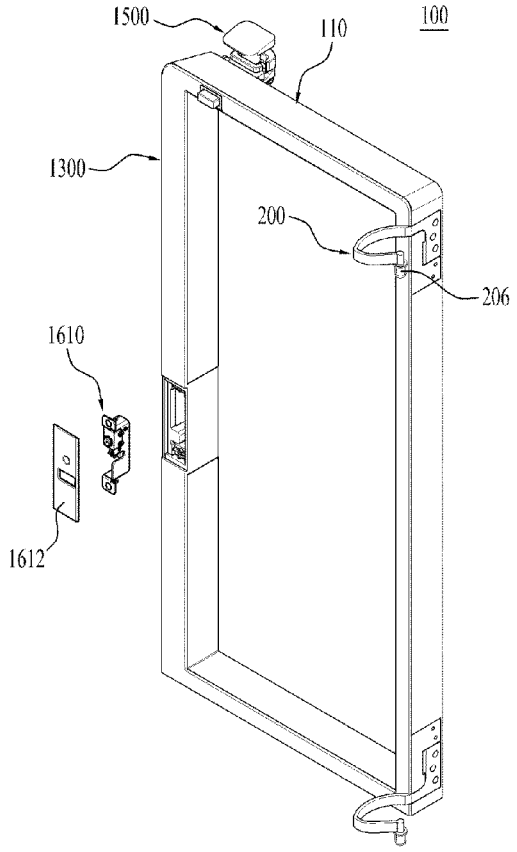

[Fig. 15]
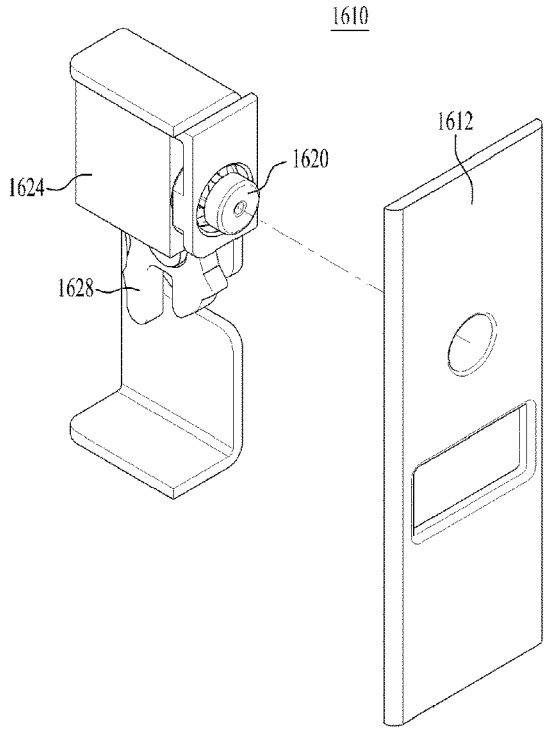
[Fig. 16]
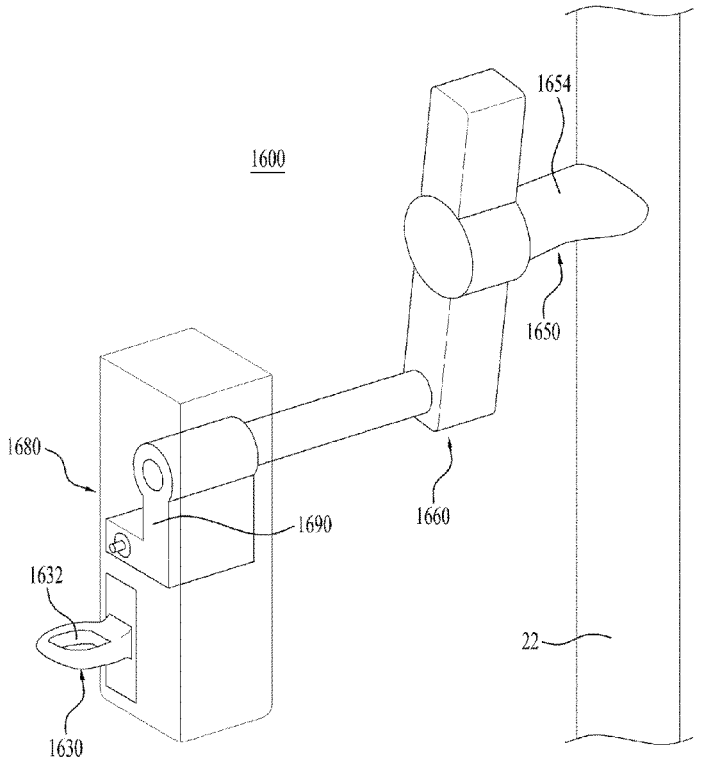

[Fig. 17]
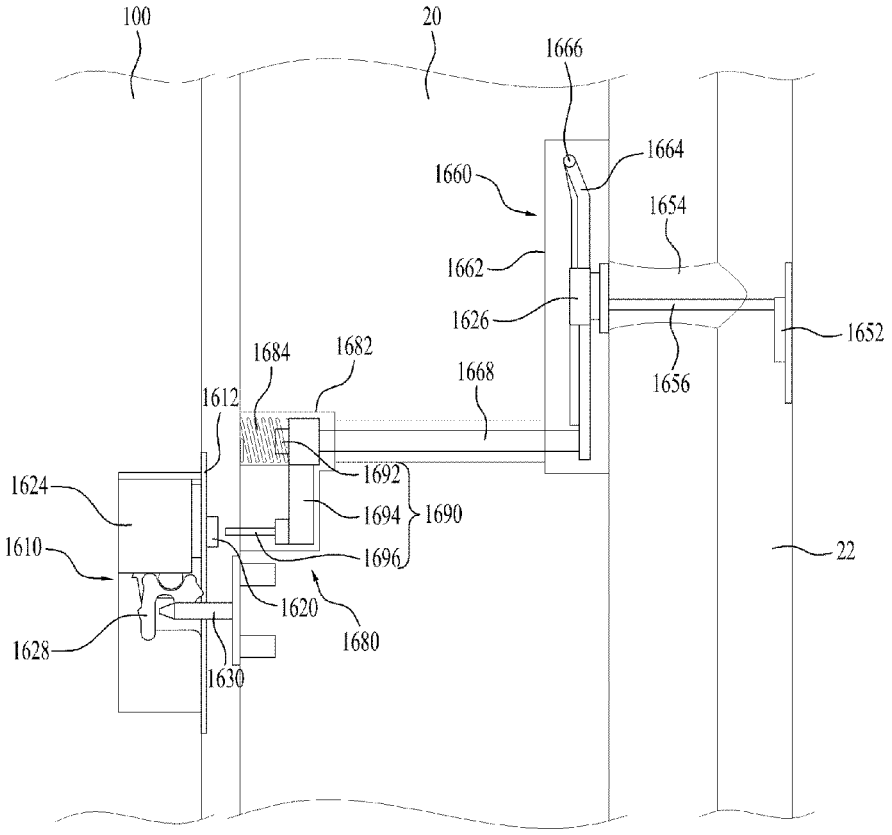
[Fig. 18]
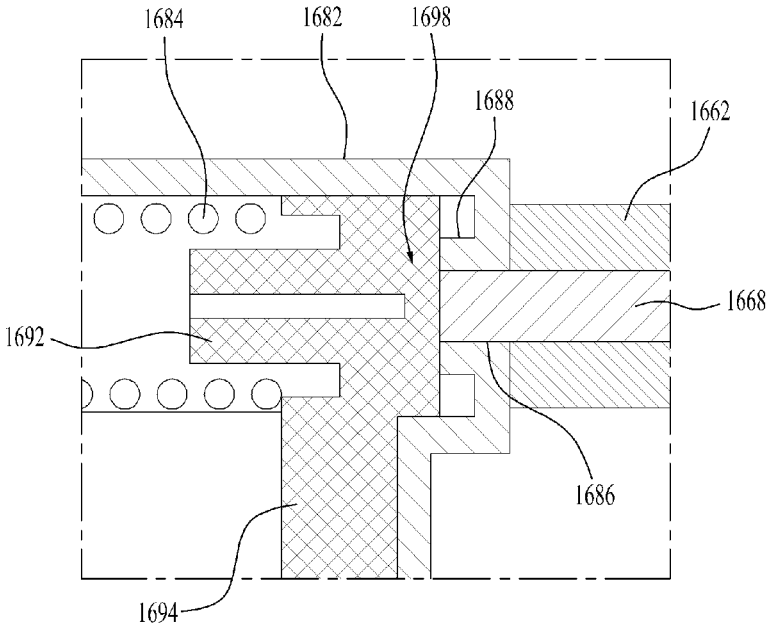

[Fig. 19]
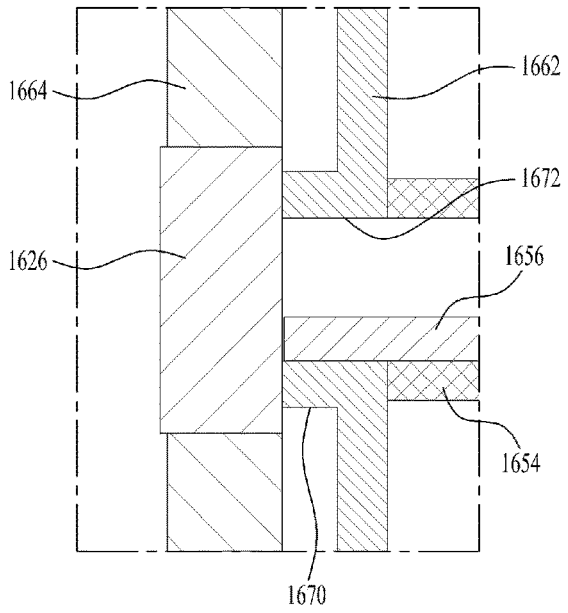
[Fig. 20]
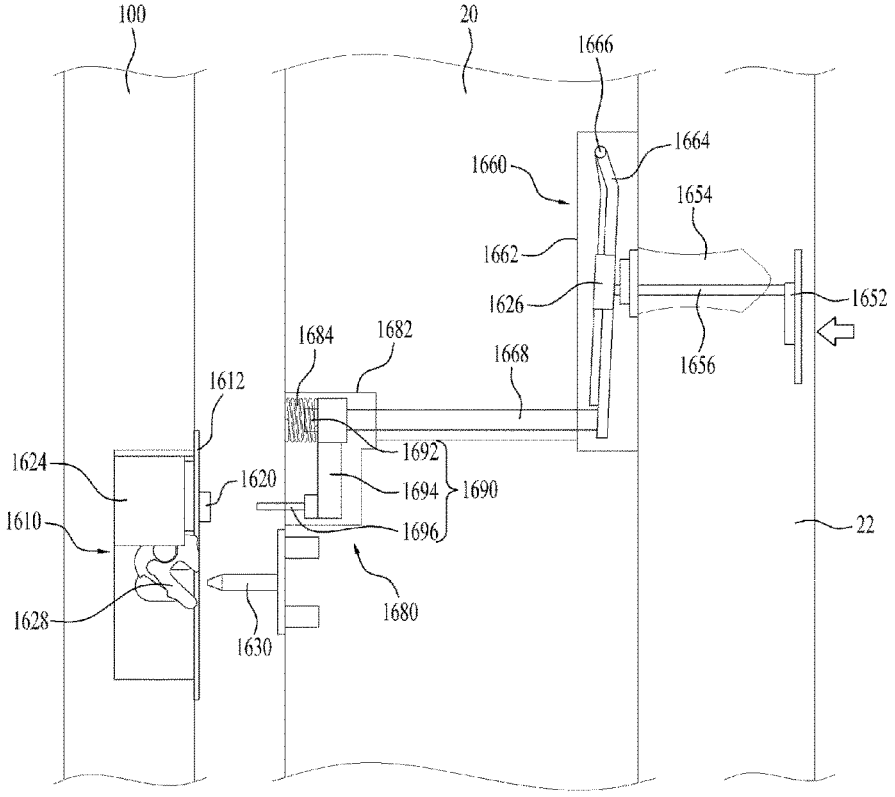

[Fig. 21]
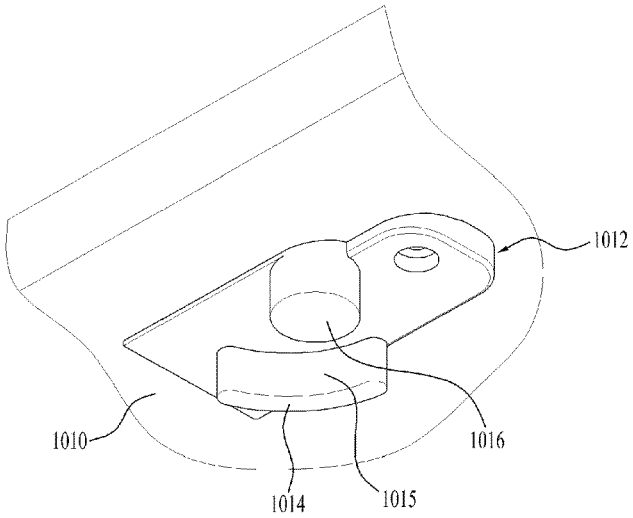
[Fig. 22]
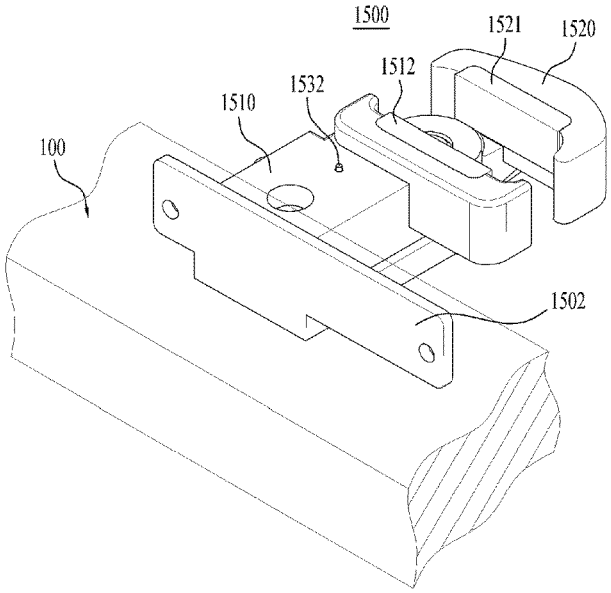
[Fig. 23]
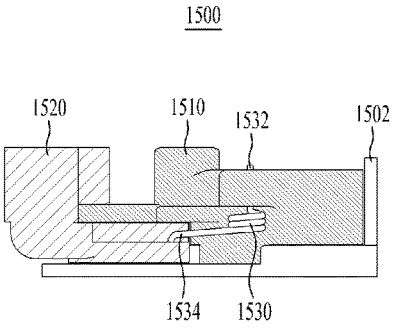

[Fig. 24]
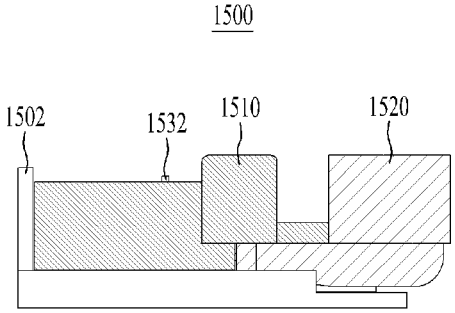
[Fig. 25]
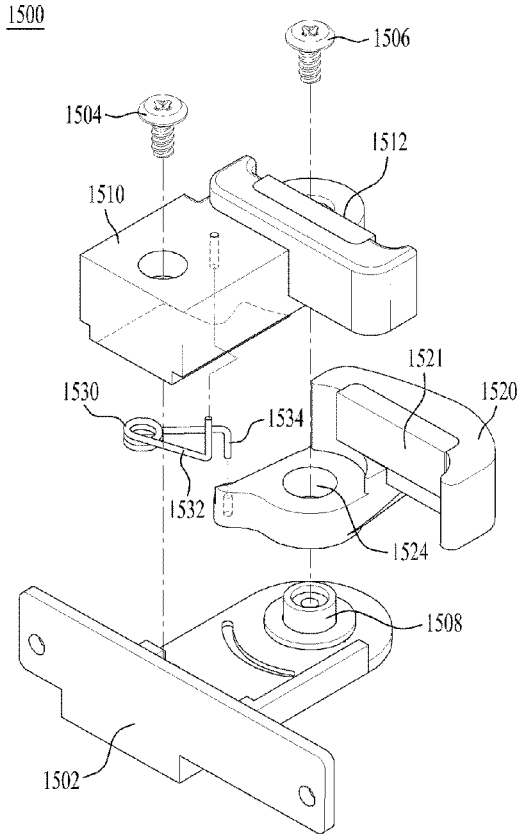

[Fig. 26]
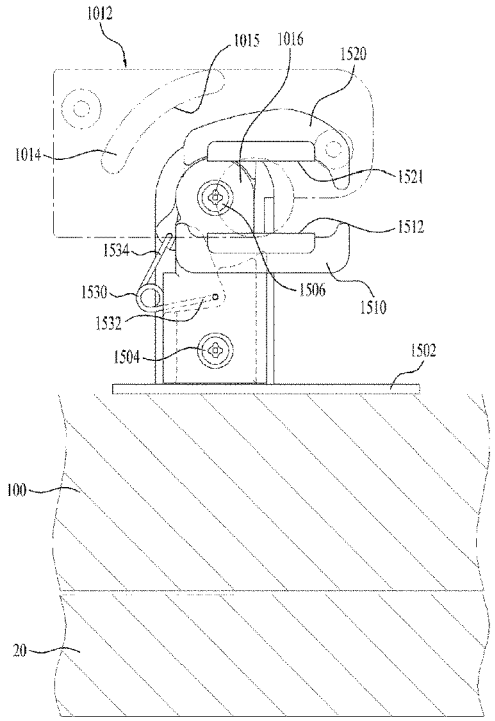
[Fig. 27]
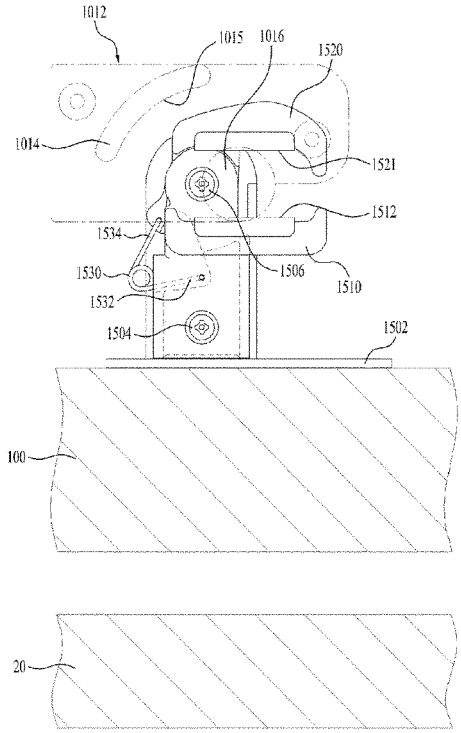

[Fig. 28]
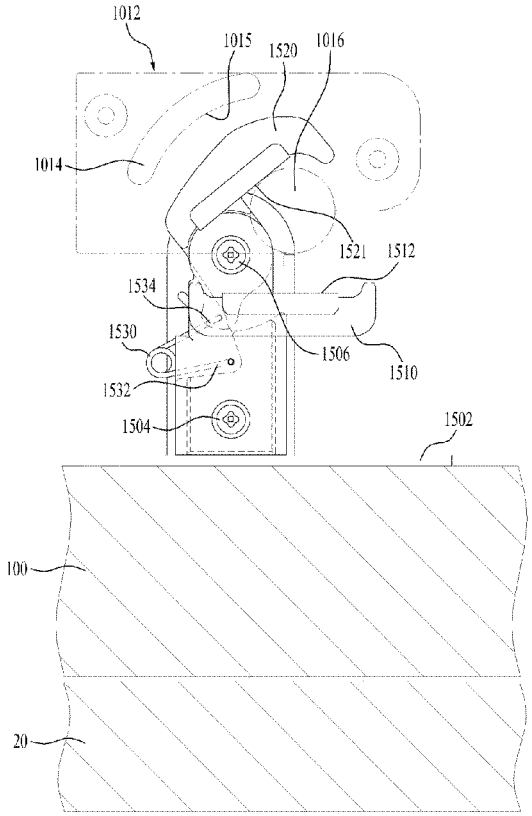

REFRIGERATOR

CROSS REFERENCE TO RELATED APPLICATIONS

This application is a U.S. National Phase Application under 35 U.S.C. § 371 of International Application PCT/KR2014/005249, filed on Jun. 16, 2014, which claims the benefit of Korean Application Nos. 10-2013-0068184 and 10-2013-0068234, filed on Jun. 14, 2013 and Korean Application No. 10-2013-0124732, filed on Oct. 18, 2013, the entire contents of which are hereby incorporated by reference in their entireties.

TECHNICAL FIELD

The present invention relates to a refrigerator and, more particularly, to a refrigerator which includes an extra storage compartment in addition to a main storage compartment, thereby enhancing user convenience.

BACKGROUND ART

In general, a refrigerator is an apparatus that stores food and the like refrigerated or frozen by keeping a storage compartment defined in the refrigerator at a predetermined temperature using a refrigeration cycle consisting of a compressor, a condenser, an expansion valve and an evaporator. Such a refrigerator generally includes a freezing compartment in which food or beverages are kept frozen and a refrigerating compartment in which food or beverages are kept at a low temperature.

Refrigerators may be classified based on positions of the freezing compartment and the refrigerating compartment. For example, refrigerators may be classified into a top mount type refrigerator in which the freezing compartment is located above the refrigerating compartment, a bottom freezer type refrigerator in which the freezing compartment is located below the refrigerating compartment and a side by side type refrigerator in which the freezing compartment and the refrigerating compartment are left and right compartments divided by a partition.

The freezing compartment and the refrigerating compartment are defined in a cabinet that forms an external appearance of the refrigerator and are selectively opened or closed by a freezing compartment door and a refrigerating compartment door respectively. The freezing compartment door and the refrigerating compartment door are pivotally rotatably coupled to the freezing compartment and the refrigerating compartment which have open front sides. Each door is provided with a gasket for hermetic sealing of the interior of the storage compartment.

In recent years, refrigerators to satisfy various consumer demands and to prevent loss of cold air caused by frequent door opening/closing have been proposed. For example, a refrigerator, which includes an extra storage space (hereinafter referred to as "auxiliary storage compartment" for convenience) in addition to a main storage compartment and allows a user to access the auxiliary storage compartment without opening a door of the refrigerator, has been proposed.

In addition, studies to enhance user convenience by allowing a user to selectively access the main storage compartment and the auxiliary storage compartment of the refrigerator have been conducted.

DISCLOSURE OF INVENTION

Technical Problem

The present invention is directed to solving the above-described problems and one object of the present invention is to provide a refrigerator which may enhance user convenience and restrict increase in power consumption and which has a simplified configuration.

Another object of the present invention is to provide a refrigerator in which a door and a container are individually or simultaneously rotated according to user convenience to enable user access thereto.

A further object of the present invention is to provide a refrigerator which may prevent leakage of cold air through a door.

Solution to Problem

To achieve the above-described objects, in accordance with one embodiment of the present invention, there is provided a refrigerator including a cabinet configured to define a first storage region in which food is stored, a door rotatably connected to a first rotating shaft via a first hinge member to open or close the first storage region, the first rotating shaft being located at the front of the cabinet, a gasket provided at the door, a container configured to define a second storage region, the second storage region being received in the first storage region, the container being rotatably connected to a second rotating shaft via a second hinge member, the second rotating shaft being located at the door, a latch member installed to the container, and a fastening device provided at the door, the fastening device being caught by the latch member to selectively couple the door and the container to each other, wherein the fastening device includes a seal configured to prevent outward movement of cold air through the fastening device in a state in which the door and the container are coupled to each other.

The seal may block a flow path for movement of cold air within the fastening device.

The fastening device may further include a hook configured to be caught and fixed by the latch member, and the hook may be pivotally rotatably installed.

The hook may be located in a region surrounded by the gasket.

Of course, the fastening device may include an operating unit having a lever configured to be pushed by a user, and a first link and a second link configured to transfer displacement generated by the lever, and the second link may pivotally rotate the hook.

Meanwhile, the first link and the second link may be separate components.

The refrigerator may further include a first housing having a first bore into which the first link is inserted, the first bore guiding movement of the first link, and the first bore and the first link may have the same cross sectional area.

In particular, the refrigerator may further include a second housing having a second bore into which the second link is inserted, the second bore guiding movement of the second link, and the second bore and the second link may have the same cross sectional area.

The seal may be located at one end of the hook, and the seal may selectively hermetically seal one end of the second bore.

The first link and the second link may have movement directions perpendicular to each other.

The door may include an elastic protrusion configured to protrude toward the container, and the elastic protrusion may be compressively deformed when the door and the container are coupled to each other.

In particular, the refrigerator may further include a handle formed at the door, and the handle may be located at a front surface of the door.

The refrigerator may further include a handle formed at the door, and the handle may be located at a side surface of the door.

The seal may open a flow path for movement of cold air into the fastening device in a state in which the fastening device is not caught by the latch member.

Advantageous Effects of Invention

Effects of a refrigerator according to the present invention as described above are as follows.

Firstly, according to the present invention, a single door is provided to open or close a main storage region and an auxiliary storage region. As such, it is possible to reduce loss of cold air as compared to the case in which two doors are provided and it is unnecessary to install a heater to prevent dew formation. Accordingly, increase in power consumption may be advantageously prevented.

Secondly, according to the present invention, a user may rotate a door alone when it is desired to access a container in which an auxiliary storage region is defined and may rotate the door and the container together when it is desired to access a refrigerating compartment or a freezing compartment, which may enhance user convenience.

Thirdly, according to the present invention, the container may be fixed so as not to wobble once a user has coupled the container and the door to each other, which may reduce noise generated by the container.

Fourthly, according to the present invention, it is possible to prevent leakage of cold air from a storage compartment through a configuration of a fastening device that couples the door and the container to each other.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a perspective view showing an embodiment of a refrigerator according to the present invention;

FIG. 2 is a perspective view showing a state in which a door of the refrigerator shown in FIG. 1 is opened alone;

FIG. 3 is a perspective view showing a state in which a container and the door of the refrigerator shown in FIG. 1 are opened;

FIG. 4 is a view showing a handle shown in FIG. 1;

FIG. 5 is a view showing a fastening device and a latch member shown in FIG. 4;

FIG. 6 is a perspective view showing important parts of the fastening device shown in FIG. 4;

FIG. 7 is a view showing an installed state of the fastening device shown in FIG. 6;

FIG. 8 is a perspective view showing another embodiment of the refrigerator according to the present invention;

FIG. 9 is a view showing a state in which the door and the container shown in FIG. 8 are individually opened;

FIG. 10 is a view showing the handle shown in FIG. 8 and the fastening device;

FIG. 11 is a view showing important parts of FIG. 8;

FIG. 12 is a sectional view taken along line A-A of FIG. 8;

FIG. 13 is a view showing operation of the fastening device shown in FIG. 8;

FIG. 14 is a view showing a state in which a latch member according to another embodiment is installed to the container;

FIG. 15 is a view showing a configuration of the latch member shown in FIG. 14;

FIG. 16 is a view showing a fastening device shown in FIG. 14;

FIG. 17 is a view showing a state in which the fastening device shown in FIG. 16 is coupled to the latch member;

FIG. 18 is a sectional view showing a connection region between a transfer member and an amplifier member shown in FIG. 17;

FIG. 19 is a sectional view showing a connection region between a button member and the amplifier member shown in FIG. 17;

FIG. 20 is a view showing a state in which coupling of the fastening device and the latch member of FIG. 17 is released;

FIG. 21 is a view showing a clasp of a fixing device according to one embodiment of the present invention;

FIG. 22 is a view showing a coupler according to one embodiment;

FIG. 23 is a left side view of FIG. 22;

FIG. 24 is a right side view of FIG. 22;

FIG. 25 is an exploded perspective view of FIG. 22;

FIG. 26 is a view showing operation of the fixing device in the state of FIG. 1 according to one embodiment;

FIG. 27 is a view showing operation of the fixing device in the state of FIG. 2 according to one embodiment; and FIG. 28 is a view showing operation of the fixing device in the state of FIG. 3 according to one embodiment.

BEST MODE FOR CARRYING OUT THE INVENTION

Hereinafter, preferred embodiments of the present invention to concretely achieve the above-described objects will be described with reference to the accompanying drawings.

The size, shape or the like of components shown in the drawings may be exaggerated for clarity and convenience of description. In addition, the terms, particularly defined by taking into consideration the configurations and functions of the present invention, may be replaced by other terms based on intensions of users or operators or customs. Hence, the meanings of these terms must follow definitions described in the entire specification.

In FIG. 1, a storage compartment in which food and the like may be stored, for example, a refrigerating compartment is defined in a cabinet 10 and a freezing compartment is also defined below the refrigerating compartment. To open or close the refrigerating compartment, a door 20 is rotatably installed to an upper portion of the cabinet 10 via a hinge member 40 (hereinafter referred to as "first hinge member" for convenience). Although the present embodiment illustrates two doors 20 to open or close the refrigerating compartment, it will be appreciated that the present embodiment is not limited thereto and a single door may be used. The door 20 is provided with a handle 22 to assist a user in pivotally rotating the door 20. Of course, the shape or structure of the handle 22 is not limited to illustration of the drawing and various other structures may be selected.

A dispenser 30 may be installed in the door 20 to provide the user with water or ice. An additional door 20*a* may be installed to a lower portion of the cabinet 10 to open or close the freezing compartment.

Meanwhile, as exemplarily shown in FIG. 2, a storage space in which food may be stored, i.e. the refrigerating compartment 2 is defined in the cabinet 10. Although the present embodiment mainly describes the refrigerating compartment for convenience of description, the present embodiment is not limited to the refrigerating compartment and may be applied to any other storage space, such as, for example, the freezing compartment so long as it may store food and the like therein. Therefore, for convenience, the storage space is referred to as "first storage region".

In the present embodiment, there is provided a container 100 that defines a storage compartment 52 (hereinafter referred to as "second storage region" for convenience) separate from the first storage region 2. The container 100 is rotatable relative to the door 20. That is, the container 100 is a separate component that is operated independently of the cabinet 10 and the door 20.

Hereinafter, a relationship of the cabinet 10, the door 20 and the container 100 and configurations of the same will be described in detail with reference to FIG. 2. FIG. 2 shows a state in which the container 100 is received in the cabinet 10 and the door 20 is opened alone.

The door 20 is pivotally rotatably coupled to the cabinet 10 via the first hinge member 40. The first hinge member 40 is located at one side of the cabinet 10. The door 20 is pivotally rotatable about a rotating shaft 42 (hereinafter referred to as "first rotating shaft" for convenience) of the first hinge member 40 and may open or close the first storage region 2.

A gasket 26 is attached to an inner surface of the door 20. The gasket 26 is located along a rim of the door 20. The gasket 26 may generally take the form of a rectangular band conforming to a rectangular shape of the door 20. Once the door 20 is rotated toward the cabinet 10 to hermetically seal the first storage region 2, the gasket 26 comes into contact with a front surface portion 12 of the cabinet 10, thus functioning to prevent leakage of cold air from the first storage region 2.

Meanwhile, the container 100 is pivotally rotatably coupled to the door 20 via a second hinge member 200. A rotating shaft (hereinafter referred to as "second rotating shaft" for convenience) of the second hinge member 200 is located at the door 20 and is separate from the first rotating shaft 42 of the first hinge member 40. That is, the first hinge member 40 is interposed between the cabinet 10 and the door 20 and the second hinge member 200 is interposed between the door 20 and the container 100.

Hereinafter, for convenience of description, the terms "up-and-down direction", "left-and-right direction" and "front-and-rear direction" as described in FIG. 2 are used. Preferably, dimensions of the container 100 (a left-and-right direction length (width) and an up-and-down direction length (height)) must substantially be at least not greater than those of the first storage region 2 such that the container 100 is received in the first storage region 2. A depth (front-and-rear direction length) of the container 100 preferably occupies a predetermined part of a depth of the first storage region 2. Through this configuration, when the door 20 is closed, the container 100 is placed in the first storage region 2 and, therefore, leakage of cold air may occur only through a gap between the front surface portion 12 of the cabinet 10 and an inner rim portion of the door 20. Thus, it is possible to prevent leakage of cold air by simply attaching the single gasket 26 to the inner rim portion of the door 20. Accordingly, in the present embodiment, the gasket 26 for the door 20 may be sufficient without requiring a gasket for the container 100. In this way, according to the present invention, it is possible to effectively prevent loss of cold air due to installation of a number of gaskets, waste of power required for heating and the like.

Meanwhile, a fastening device 600 to selectively couple the container 100 and the door 20 to each other is preferably installed to the door 20. More specifically, the fastening device 600 functions to couple the door 20 and the container 100 to each other when it is desired to open the door 20 and the container 100 together and also functions to release coupling of the door 20 and the container 100 when it is desired to open the door 20 alone. To implement coupling and release of the door 20 and the container 100 via the fastening device 600, the handle 22 is preferably provided with an operating unit.

Meanwhile, a storage member 24 for storage of food therein may be installed to the inner surface of the door 20. More specifically, after the door 20 is opened by the user as exemplarily shown in FIG. 2, the user may access the storage member 24 to store food in the storage member 24 installed to the inner surface of the door 20 or to retrieve the stored food. Of course, instead of providing the door 20 with the storage member 24, the container 100 may be increased in depth such that the container 100 uses a space occupied by the storage member 24 of the door 20.

Next, a case in which the door 20 and the container 100 are opened together will be described with reference to FIG. 3.

When the user who desires to use the first storage region 2 opens the door 20 and the container 100 together, the user can access the first storage region 2. The first storage region 2 may have substantially the same configuration as that of a storage compartment of a general refrigerator. For example, the first storage region 2 may contain a plurality of shelves 4 and drawers 6 and the like.

Meanwhile, the container 100 is preferably provided with a coupler 1500 of a fixing device to selectively couple the container 100 to the cabinet 10. More specifically, the coupler 1500 of the fixing device functions to couple the container 100 and the cabinet 10 to each other when it is desired to open the door 20 alone and also functions to release coupling of the container 100 and the cabinet 10 when it is desired to open the door 20 and the container 100 together.

FIG. 4 is a view showing the handle shown in FIG. 1. A description with reference to FIG. 4 is as follows.

As exemplarily shown in FIG. 4, the door 20 is provided with the handle 22 to assist the user in pivotally rotating the door 20 by gripping the handle 22 with the hand.

In this case, the handle 22 may be attached to a front surface of the door 20 for easy user access.

The handle 22 may be provided with an operating unit 650 at a portion thereof where the user's hand will touch. In this case, the operating unit 650 may be configured such that the user can push the operating unit 650.

More specifically, the operating unit 650 is exposed to the user to allow the user to push the operating unit 650 in a state in which the door 20 hermetically seals the first storage region 2. Thus, the user can access the operating unit 650 in a state in which the door 20 closes the first storage region 2, thereby controlling a coupling relationship between the container 100 and the door 20 using the operating unit 650.

FIG. 5 is a view showing the fastening device and the latch member shown in FIG. 4, FIG. 6 is a perspective view showing important parts of the fastening device shown in FIG. 4 and FIG. 7 is a view showing an installed state of the fastening device shown in FIG. 6. A description with reference to FIGS. 5 to 7 is as follows.

The fastening device 600 may be installed to the door 20 to selectively couple the door 20 to the container 100. That is, through use of the fastening device 600, the user may couple the door 20 to the container 100 in order to rotate the door 20 and the container 100 together, or may separate the door 20 from the container 100 in order to individually rotate the door 20 and the container 100.

As exemplarily shown in FIG. 5, the container 100 has a recess 120 indented in a surface thereof facing the door 20 by a predetermined depth. A latch member 130 in the form of a horizontally extending elongated bar is received in the recess 120.

As the latch member 130 is coupled to the fastening device 600, the door 20 and the container 100 may be coupled to each other or released from each other.

As exemplarily shown in FIG. 6, the fastening device 600 includes a rotatable hook 620. The hook 620 may be installed to vertically rotate about a rotating shaft that is horizontally installed to a case 610.

The hook 620 may have a downwardly protruding tip portion 622 to be caught by the latch member 130. That is, a state in which the protruding tip portion 622 is caught by the latch member 130 refers to a state in which the container 100 and the door 20 are coupled to each other.

Meanwhile, a seal 626 may be located at the back of the hook 620 to prevent cold air of the first storage region 2 from being discharged outward through a passage formed at the back of the hook 620. That is, the seal 626 may block the passage through which cold air can move into the fastening device 600. In particular, the seal 626 may be formed of an elastically deformable material, such as rubber or the like. The seal 626 may be slightly deformed to hermetically seal an open end of the passage.

As exemplarily shown in FIG. 5, the fastening device 600 may include the operating unit 650 that the user can operate. The fastening device 600 may further include a first link 662 and a second link 672 which transfer operating force of the operating unit 650 to the hook 620.

The operating unit 650 may include a lever 652 and the user can cause displacement by pushing the lever 652. In this case, the lever 652 may be moved leftward on the basis of FIG. 5 when the user pushes the lever 652, or may be moved rightward on the basis of FIG. 5 when the user no longer pushes the lever 652.

The fastening device 600 may further include a first housing 660 having a first bore 664 through which the first link 662 is inserted, the first bore 664 guiding movement of the first link 662. In this case, the first bore 664 and the first link 662 may have the same cross sectional area. Through this configuration, it is possible to prevent cold air of the first storage region 2 from being discharged outward through the first bore 664 and to easily guide movement of the first link 662.

In addition, the fastening device 600 may include a second housing 670 having a second bore 674 through which the second link 672 is inserted, the second bore 674 guiding movement of the second link 672. In this case, the second bore 674 and the second link 672 may have the same cross sectional area. Through this configuration, it is possible to prevent cold air of the first storage region 2 from being discharged outward through the second bore 674 and to easily guide movement of the second link 672.

The second housing 670 may be embedded in the door 20 and the first housing 660 may be embedded in an extension between the door 20 and the handle 22.

Meanwhile, the first link 662 and the second link 672 may be separate components. This is because, assuming that the first link 662 and the second link 672 take the form of a single component, the first link 662 and the second link 672 may cause excessive heat transfer via conduction therethrough. That is, when the first link 662 and the second link 672 take the form of separate components, the first link 662 and the second link 672 that usually come into contact with each other may be intermittently separated from each other, which may prevent conductive heat transfer and, consequently, prevent leakage of cold air.

As exemplarily shown in FIG. 7, the door 20 may be provided at a surface thereof facing the container 100 with an elastic protrusion 680, the elastic protrusion 680 protruding toward the container 100. The elastic protrusion 680 is compressively deformed when the door 20 and the container 100 are coupled to each other, thereby maintaining a constant gap between the door 20 and the container 100.

The container 100 and the door 20 which have been coupled to each other may not accurately come into contact with each other due to manufacturing errors, which may cause vibration due to collision between the container 100 and the door 20.

Therefore, in the present invention, once the container 100 and the door 20 are coupled to each other, the elastic protrusion 680 may be compressed to maintain a constant gap between the container 100 and the door 20, thereby preventing vibration caused by contact between the door 20 and the container 100. Through provision of the elastic protrusion 680, it is possible to prevent breakage of components and generation of noise due to collision between the door 20 and the container 100.

The hook 620 may be located in a region surrounded by the gasket 26. That is, the hook 620 may be located in a space communicating with the first storage region 2 hermetically sealed by the gasket 26. As described above with reference to FIGS. 1 to 3, the container 100 must be smaller than the door 20 and also must be sized to be received in the first storage region 2. Accordingly, the hook 620, which causes the container 100 and the door 20 to come into contact with and be coupled to each other, is preferably located in the first storage region 2.

Hereinafter, operation of the fastening device 600 will be described.

When the user pushes the lever 652, the lever 652 is moved leftward on the basis of FIG. 5. The first link 662 and the second link 672 are simultaneously moved leftward by the same distance as a movement distance of the lever 652. The second link 672 pushes the seal 626 of the hook 620 and the hook 620 is rotated clockwise about the rotating shaft. Thereby, as the protruding tip portion 622 is moved upward of the latch member 130, the hook 620 is released from the latch member 130.

Accordingly, coupling of the door 20 and the container 100 is released and the door 20 and the container 100 are separated from each other and are rotatable.

The interior of the first bore 664 is filled with the first link 662 because the first link 662 and the first bore 664 have the same cross sectional area. That is, despite movement of the first link 662, it is possible to prevent leakage of cold air through the first bore 664.

Likewise, the interior of the second bore 674 is filled with the second link 672 because the second link 672 and the second bore 674 have the same cross sectional area. That is, despite movement of the second link 672, it is possible to prevent leakage of cold air through the second bore 674.

However, in the state shown in FIG. 5, the seal 626 is rotated clockwise and does not hermetically seal an open end of the second bore 674. That is, once coupling of the door 20 and the container 100 is released, the end of the second bore 674 may allow movement of cold air.

On the other hand, when the user no longer pushes the lever 652, the lever 652 returns to an original position thereof, i.e. is moved rightward. Thereby, the first link 662 and the second link 672 are moved rightward and the hook 620 is rotated counterclockwise.

Accordingly, as the protruding tip portion 622 is caught by the latch member 130, the hook 620 is caught by the latch member 130. In this way, the door 20 and the container 100 are coupled to each other and the user can rotate the door 20 and the container 100 together.

In this case, the seal 626 of the hook 620 hermetically seals the end of the second bore 674, thereby preventing cold air of the first storage region 2 from being discharged outward through the second bore 674.

FIG. 8 is a perspective view showing another embodiment of the refrigerator according to the present invention and FIG. 9 is a view showing a state in which the door and the container shown in FIG. 8 are individually opened. A description with reference to FIGS. 8 and 9 is as follows.

FIGS. 8 and 9 show an embodiment in which a single door 20 is installed to open or close the first storage region 2, differently from the above-described embodiment. That is, the user may open or close the entire first storage region 2 by rotating the single door 20.

In the following description of the secondly described embodiment, components to implement the same functions as those of the above-described embodiment are designated by the same reference numerals. A description related to the same parts will be omitted below and only different parts will be described.

The handle 22 may be attached to a side surface of the door 20. Since the single door 20 is used to open or close the first storage region 2, in the secondly described embodiment, the user can access to the side surface of the door 20 differently from in the above-described embodiment.

FIG. 10 is a view showing the handle shown in FIG. 8 and the fastening device and FIG. 11 is a view showing important parts of FIG. 8. A description with reference to FIGS. 10 and 11 is as follows.

As exemplarily shown in FIG. 10, the handle 22 is located adjacent to the fastening device 600. As such, operating force of the handle 22 may be transferred to the fastening device 600.

As exemplarily shown in FIG. 11, the handle 22 may include a bracket 23 to which the lever 652 is installed. The lever 652 may be pivotally rotatably installed to the bracket 23. In this case, the lever 652 may be installed to the bracket 23 so as to be rotated about an upper end thereof.

The first housing 660 and the second housing 670 may configure a single component. In this case, the first link 662 and the second link 672 may be inserted into the first housing 660 and the second housing 670 and the first housing 660 and the second housing 670 may guide movement of the first link 662 and the second link 672.

The first link 662 and the second link 672 are separate components and the user may replace the first link 662 and the second link 672 individually. Assuming that the first link 662 and the second link 672 configure a single component, both the first link 662 and the second link 672 must be replaced when damage to a portion of the single component corresponding to the first link 662 or the second link 672 occurs. Therefore, in the present invention, the two components are designed to be separable from each other to enhance product use convenience.

In particular, the first link 662 and the second link 672 in the form of separate components may prevent increase in the length thereof, which enables reduction in the size of components. As such, a user working space for individual replacement or repair of the first link 662 and the second link 672 may be reduced and easier replacement or repair work may be possible.

FIG. 12 is a sectional view taken along line A-A of FIG. 8 and FIG. 13 is a view showing operation of the fastening device shown in FIG. 8. A description with reference to FIGS. 12 and 13 is as follows.

The first link 662 and the second link 672 may be moved in directions perpendicular to each other. On the basis of FIG. 12, the first link 662 may be moved in a vertical direction, whereas the second link 672 may be moved in a horizontal direction.

Meanwhile, the first link 662 may have a first slope 668 having a predetermined inclination angle and the second link 672 may have a second slope 676 to be guided by the first slope 668 by coming into contact with the first slope 668.

As such, vertical movement of the first link 662 may be converted into horizontal movement of the second link 672.

In addition, the lever 652 and the first link 662 may be moved in directions perpendicular to each other. On the basis of FIG. 12, the lever 652 may be horizontally rotated, whereas the second link 672 may be vertically moved.

Meanwhile, the lever 652 may have a fourth slope 654 having a predetermined inclination angle and the first link 662 may have a third slope 666 to be guided by the fourth slope 654 by coming into contact with the fourth slope 654.

The first link 662 is provided at a portion thereof adjacent to the lever 652 with the third slope 666 and at a portion thereof adjacent to the second link 672 with the first slope 668. As such, the first link 662 may transfer movement of the lever 652 to the second link 672.

In the secondly described embodiment, it is possible to prevent easy leakage of cold air from the first storage region 2 because a movement path of the first link 662 (vertical path) and a movement path of the second link 672 (horizontal path) are perpendicular to each other. That is, it is possible to prevent cold air of the first storage region 2 from being discharged outward.

Operation of the secondly described embodiment will be described below with reference to FIG. 13.

When the user pushes the lever 652, the fourth slope 654 is moved. In this case, the third slope 666 coming into contact with the fourth slope 654 is moved via movement of the fourth slope 654.

The first link 662 is moved and the first slope 668 is moved linearly along with the first link 662.

The second slope 676 comes into contact with the first slope 668 and the second link 672 is linearly moved. In this case, movement directions of the first link 662 and the second link 672 are perpendicular to each other.

The hook 620 may be rotatable and the container 100 and the door 20 may be switched from a coupled state to a released state or vice versa.

Meanwhile, the seal 626 may be located at one end of the hook 620 so as to hermetically seal one end of the second bore 674, thereby preventing cold air of the first storage region 2 from moving to the second bore 674.

In particular, the seal 626 hermetically seals a cold air movement passage when the fastening device 600 (more particularly, the hook 620) is caught by the latch member 130 and opens the passage when the fastening device 600 is not caught by the latch member 130.

Even if the seal 626 temporarily opens one end of the second bore 674, a possibility of movement of cold air through the first bore 664 or the second bore 674 may be reduced because the first bore 664 is filled with the first link 662 and the second bore 674 is filled with the second link 672.

Considering use of the refrigerator by the user, the container and the door are coupled to each other by the fastening device for a majority of the time. This is because coupling by the fastening device corresponds to an initial position and the door and the container are released from each other when the user operates the lever. Accordingly, in the present invention, it is possible to reduce leakage of cold air during use of the refrigerator by providing an additional sealing structure to prevent leakage of cold air in a state in which the door and the container are coupled to each other by the fastening device (for a majority of the time).

FIG. 14 is a view showing a state in which a latch member 1610 according to another embodiment is installed to the container 100. In FIG. 14, the latch member 1610 is shown as being separated from the container 100. A description with reference to FIG. 14 is as follows.

The container 100 includes a body 110 forming an external appearance of the container 100 and a cover 1300 coupled to the body 110. The cover 1300 closes an open side of the body 110 to prevent an inner region of the body 110 from being partially exposed outward.

Meanwhile, a latch member 1610 may be installed to the container 100. In this case, the latch member 1610 may include a cover 1612 configured to cover the front of the latch member 1610. The cover 1612 may prevent a portion of the latch member 1610 from being exposed to the user, thereby preventing the latch member 1610 from being unintentionally operated by the user.

The latch member 1610 and the cover 1612 are installed to the container 100 so as to come into contact with the door 20.

Preferably, the coupler 1500 of the fixing device is installed to the top of the container 100 to selectively couple the container 100 to the cabinet 10. That is, the coupler 1500 of the fixing device functions to couple the container 100 and the cabinet 10 to each other when it is desired to open the door 20 alone and also functions to release coupling of the container 100 and the cabinet 10 when it is desired to open the door 20 and the container 100 together. The coupler 1500 of the fixing device may selectively come into contact with an inner ceiling surface of the first storage region 2 so as to selectively fix the container 100 to the first storage region 2.

The second hinge member 200 may include a rotating shaft 206 coupled to the door 20. The rotating shaft 206 may be rotatably coupled to the door 20 to allow the container 100 to be rotated about the rotating shaft 206.

Meanwhile, a total of two second hinge members 200 may be installed at upper and lower positions of the container 100 respectively. The second hinge members 200 have the same shape and differ only in terms of installation positions thereof in relation to the container 100 and the door 20.

FIG. 15 is a view showing a configuration of the latch member 1610 shown in FIG. 14. A description with reference to FIG. 15 is as follows.

The latch member 1610 may include a push piece 1620 to be pushed by the operating unit installed to the door 20, a drive piece 1624 to convert force applied to the push piece 1620 into torque and transmit the torque and a hook 1628 to be rotated by the drive piece 1624.

The push piece 1620 may be exposed outward of the container 100 so as to be pushed by any component installed to the door 20.

The drive piece 1624 may convert horizontal linear force applied to the push piece 1620 into torque. The drive piece 1624 may be a combination of various cams and springs. Details of the drive piece 1624 may be altered in various ways, those skilled in the art can easily understand these alterations and thus a detailed description thereof will be omitted herein.

The hook 1628 may generally have a "ㄷ"-shaped form, one end of which is open. The hook 1628 is rotatable about a rotating shaft.

The open end of the hook 1628 may be oriented downward when the drive piece 1624 applies no force to the hook 1628. On the other hand, when the drive piece 1624 rotates the hook 1628, the open side of the "ㄷ"-shaped hook 1628 may be oriented toward the door 20.

Meanwhile, the cover 1612 is installed at one side of the latch member 1610. The cover 1612 may prevent the interior of the latch member 1610 from being exposed to the user.

In addition, the cover 1612 may allow only the hook 1628 and the push piece 1620 to be exposed, thereby allowing the latch member 1610 to come into contact with and be driven by the door 20.

FIG. 16 is a view showing the fastening device shown in FIG. 14. A description with reference to FIG. 16 is as follows. In FIG. 16, illustration of the door 20 is omitted to clearly show a fastening device 1600 that is embedded in the door 20.

The fastening device 1600 includes a button member 1650 to generate displacement by being pushed by the user, an amplifier member 1660 to amplify displacement generated by the button member 1650 and a transfer member 1680 to transfer displacement generated by the amplifier member 1660 to the latch member 1610.

The button member 1650 may be oriented to face the back of the handle 22. In addition, although not shown in FIG. 16, the button member 1650 may include a button formed at the front of the handle 22 so as to be exposed to the user. For reference, a button member housing 1654 may be exposed to the user.

One end of the button member 1650 is connected to the amplifier member 1660 and one end of the amplifier member 1660 is connected to the transfer member 1680.

The transfer member 1680 is provided at one end thereof with a release pin 1690 that is exposed to the interior of the door 20. Specifically, an exposed portion of the release pin 1690 is used to push the push piece 1620.

The transfer member 1680 and the amplifier member 1660 are embedded in the door 20 and are not exposed to the user. That is, only the release pin 1690 is exposed to the user.

Meanwhile, the release pin 1690 is exposed to a space of the first storage region 2 defined by the gasket 26. Thus, although cold air of the first storage region 2 may move through the release pin 1690, the transfer member 1680 and the amplifier member 1660 are not aligned in a line and are arranged at different heights. This stepwise arrangement causes a complicated cold air movement path, thus preventing movement of cold air. Accordingly, it is possible to prevent problems due to leakage of cold air from the first storage region 2.

A holder 1630 is located adjacent to the release pin 1690. The holder 1630 is exposed outward from the door 20.

The holder 1630 may have a center holder hole 1632. As the open end of the hook 1628 is inserted into the holder hole 1632, the latch member 1610 and the fastening device 1600 may be coupled to each other. In other words, the container 100 and the door 20 may be coupled to each other.

FIG. 17 is a view showing a coupled state of the fastening device 1600 and the latch member 1610 shown in FIG. 16. A description with reference to FIG. 17 is as follows.

The button member 1650 may include a button 1652 installed at the front of the handle 22 and a push bar 1656 connected to the button 1652. The push bar 1656 is movable along with the button 1652. Through movement of the push bar 1656, displacement of the button 1652 may be transferred to the amplifier member 1660.

The push bar 1656 may be received in the button member housing 1654. The button member housing 1654 may be exposed to the door 20 to connect the handle 22 and the door 20 to each other.

When the button 1652 is moved leftward on the basis of FIG. 17, the push bar 1656 may be moved leftward by the same distance as a movement distance of the button 1652. As such, displacement of the push bar 1656 may occur.

The amplifier member 1660 may include an amplifier member housing 1662 forming an external appearance of the amplifier member 1660, a pivot bar 1664 configured to be rotated about a rotating shaft 1666 and a link bar 1668 located at one end of the pivot bar 1664 so as to be moved by pivotal rotation of the pivot bar 1664.

The pivot bar 1664 may be provided with a seal 1626 at a position thereof coming into contact with the link bar 1668. As such, in the state shown in FIG. 17, the seal 1626 may block a cold air movement path defined in the fastening device 1600.

The amplifier member housing 1662 may contain an empty space corresponding to a pivotal rotation path of the pivot bar 1664. The amplifier member housing 1662 may receive a portion of the push bar 1656.

The push bar 1656 may push the pivot bar 1664 to pivotally rotate the pivot bar 1664. The pivot bar 1664 is rotated about a rotating shaft 1666. The push bar 1656 may push a position of the pivot bar 1664 spaced apart from the rotating shaft 1666 by a predetermined distance, rather than pushing a distal end of the pivot bar 1664. On the other hand, the link bar 1668 is located adjacent to the distal end of the pivot bar 1664.

When the push bar 1656 moves the pivot bar 1664, the pivot bar 1664 in the form of a rigid bar is rotated about the rotating shaft 1666. This may cause a movement distance of the link bar 1668 to be increased beyond that of the push bar 1656. This is because a circular arc of a rotation path may increase with increasing distance from the rotating shaft 1666 even if the pivot bar 1664 is rotated about the rotating shaft 1666 by the same angle.

The transfer member 1680 includes a transfer member housing 1682 forming an external appearance of the transfer member 1680 and the release pin 1690 configured to push the push piece 1620.

The transfer member housing 1682 may be configured to receive a portion of the link bar 1668. As the link bar 1668 moves the release pin 1690, a length of the portion of the release pin 1690 protruding from the door 20 may vary.

The release pin 1690 includes a first piece 1692 coming into contact with the link bar 1668, a second piece 1696 protruding outward from the door 20 to push the latch member 1610 and a connection piece 1694 connecting the first piece 1692 and the second piece 1696 to each other. The release pin 1690 may be configured such that the first piece 1692 and the second piece 1696 are bent from the connection piece 1694. As such, the release pin 1690 may generally have a "ㄷ"-shaped form.

A spring 1684 may be located at one side of the first piece 1692. In this case, the spring 1684 is located opposite to the link bar 1668 to move the first piece 1692 toward the link bar 1668. That is, when the link bar 1668 applies no force to the release pin 1690, the first piece 1692 remains moved rightward by elastic force of the spring 1684. On the other hand, when the release pin 1690 is moved rightward by the link bar 1668, the spring 1684 may be compressed.

FIG. 18 is a sectional view showing a connection region between the transfer member and the amplifier member shown in FIG. 17. A description with reference to FIG. 18 is as follows.

The link bar 1668 is installed such that a portion thereof is received in the transfer member housing 1682.

In this case, the transfer member housing 1682 may have a through-hole 1686 for penetration of the link bar 1668.

The through-hole 1686 is provided with a first ridge 1688 protruding inward of the transfer member housing 1682 by a predetermined length. The first ridge 1688 having a predetermined length may guide movement of the link bar 1668.

Meanwhile, the first ridge 1688 may be formed of rubber to achieve an increased contact area with respect to the link bar 1668. In addition, when the first ridge 1688 is pushed rightward by the first piece 1692, the first piece 1692 and the first ridge 1688 may come into close contact with each other.

In particular, a seal 1698 may be located at a portion of the first piece 1692 facing the through-hole 1686. The seal 1698 may be integrally formed with the first piece 1692. When the seal 1698 comes into contact with the first ridge 1688, the through-hole 1686 is hermetically sealed to prevent movement of cold air through the through-hole 1686.

FIG. 19 is a sectional view showing a connection region between the button member and the amplifier member shown in FIG. 17. A description with reference to FIG. 19 is as follows.

The push bar 1656 is installed such that a portion thereof is received in the amplifier member housing 1662.

In this case, the amplifier member housing 1662 may have a communication hole 1672 for penetration of the push bar 1656.

The communication hole 1672 is provided with a second ridge 1670. The second ridge 1670 protrudes inward of the amplifier member housing 1662 by a predetermined length. The second ridge 1670 having a predetermined length may guide movement of the push bar 1656.

Meanwhile, the second ridge 1670 may be formed of rubber. When the second ridge 1670 is pushed rightward by the pivot bar 1664, the pivot bar 1664 and the second ridge 1670 may come into close contact with each other.

Once one side of the pivot bar 1664 comes into contact with the second ridge 1670, the amplifier member housing 1662 does not communicate with the button member housing 1654. Thus, it is possible to prevent cold air that may enter the amplifier member housing 1662 from moving into the button member housing 1654.

More specifically, the seal 1626 may be located at a portion of the pivot bar 1664 coming into contact with the second piece 1696. The seal 1626 may be formed of rubber to hermetically seal the communication hole 1672 when the seal 1626 comes into contact with the second ridge 1670. Once the seal 1626 hermetically seals the communication hole 1672, it is possible to prevent cold air from moving into the fastening device 1600 through the communication hole 1672.

Hereinafter, operation of the embodiment as shown in FIGS. 14 to 19 will be described.

First, the case in which the user maintains the state shown in FIG. 1 will be described below.

As exemplarily shown in FIG. 17, the button 1652 is not pushed by the user.

As the second piece 1696 does not push the push piece 1620, the hook 1628 remains not rotated and the open end of the hook 1628 is oriented downward. As such, the hook 1628 may be continuously inserted in the holder hole 1632 to maintain coupling of the hook 1628 and the holder 1630.

In conclusion, the container 100 and the door 20 may remain in a coupled state by the fastening device 1600.

Meanwhile, as described above, in the present invention, the fastening device 1600 is located in a partial region of the first storage region 2 defined by the gasket 26. As such, there is a possibility of formation of a path, along which cold air of the first storage region 2 having passed through the fastening device 1600 is discharged through the door 20, i.e. through the button 1652.

To prevent this problem, the first piece 1692 (more particularly, the seal 1698) remains in close contact with the first ridge 1688 as exemplarily shown in FIG. 18 and the pivot bar 1664 (more particularly the seal 1626) remains in close contact with the second ridge 1670 as exemplarily shown in FIG. 19. That is, as the transfer member housing 1682, the amplifier member housing 1662 and the button member housing 1654 remain in a hermetically sealed state so as not to communicate with one another, it is possible to block a cold air movement path.

Meanwhile, as exemplarily shown in FIG. 3, the user will not push the button 1652 even when the user desires to rotate the door 20 and the container 100 together. Thus, the above-described procedure is equally applied.

In the use manner as exemplarily shown in FIGS. 1 and 3, the container 100 and the door 20 remain in a coupled state by the fastening device 1600. Thus, the container 100 and the door 20 may be rotated relative to the cabinet 10 by the first hinge member 40.

The container 100 is not rotated separately from the door 20 because the door 20 and the container 100 are coupled to each other.

FIG. 20 is a view showing a state in which the fastening device 1600 and the latch member 1610 of FIG. 17 are released from each other. A description with reference to FIG. 20 is as follows.

Even when the user desires to open the door 20 alone except for the container 100 as exemplarily shown in FIG. 2, the user pushes 1652 as exemplarily shown in FIG. 20.

When the button 1652 is pushed, the button 1652 is moved leftward on the basis of FIG. 20 and the push bar 1656 is moved leftward along with the button 1652.

As one end of the push bar 1656 pushes the pivot bar 1664, the pivot bar 1664 is rotated about the rotating shaft 1666, thus causing movement of the link bar 1668. Since the link bar 1668 is located farther from the rotating shaft 1666 of the pivot bar 1664 than the push bar 1656, displacement of the link bar 1668 may be increased beyond displacement of the push bar 1656.

For example, when the user moves the button 1652 by 1 mm, the push bar 1656 is moved by 1 mm, but the link bar 1668 may be moved by 1.5 mm or 2 mm. A displacement amplification rate may be changed in various ways via change in installation positions of the push bar 1656 and the link bar 1668.

When the link bar 1668 is moved, the link bar 1668 may push the first piece 1692, thus causing the spring 1684 to be compressed. The second piece 1696 may be moved by the same movement distance as that of the first piece 1692 because the first piece 1692, the connection piece 1694 and the second piece 1696 are moved together.

A protruding length of the second piece 1696 from the door 20 increases because the second piece 1696 is moved leftward. In this way, the second piece 1696 may push the push piece 1620.

As the push piece 1620 pushes the drive piece 1624 to rotate the hook 1628, the open end of the hook 1628 is rotated toward the door 20.

Accordingly, coupling of the hook 1628 and the holder 1630 is released and, consequently, coupling of the container 100 and the door 20 is released.

The door 20 may be rotated about the first hinge member 40, whereas the container 100 may remain stationary in the first storage region 2.

Meanwhile, when the user desires to rotate the container 100, the user may rotate the container 100 about the second hinge member 200 regardless of rotation of the door 20. That is, once the fastening device 1600 releases coupling of the door 20 and the container 100, the door 20 and the container 100 may be rotated separately from each other.

FIG. 21 is a view showing a clasp of the fixing device according to one embodiment of the present invention. A description with reference to FIG. 21 is as follows.

A clasp 1012 is installed to the top of the cabinet 10 so as to protrude inward of the first storage region 2. In this case, the clasp 1012 may protrude downward from the top of the cabinet 10.

The clasp 1012 may include a cylindrical protruding guide pin 1016 and a curved guide wall 1014 having a curved surface 1015. The guide pin 1016 may have a rounded surface.

The guide pin 1016 may take the form of a cylinder having a circular cross section. The guide pin 1016 may have a predetermined radius to achieve a given level of strength. The guide wall 1014 may guide operation of some components of the fixing device using the curved surface 1015 thereof. That is, some components of the fixing device may come into contact with the curved surface 1015 so as to be moved on the curved surface 1015.

The guide pin 1016 and the guide wall 1014 may be spaced apart from each other by a predetermined distance and some components of the fixing device may be arranged between the guide pin 1016 and the guide wall 1014.

FIG. 22 is a view showing the coupler according to one embodiment, FIG. 23 is a left side view of FIG. 22, FIG. 24 is a right side view of FIG. 22 and FIG. 25 is an exploded perspective view of FIG. 22. A description with reference to FIGS. 22 to 25 is as follows.

The coupler 1500 may be selectively coupled to or released from the clasp 1012. In addition, the coupler 1500 may be installed to the top of the container 100. A position of the coupler 1500 is determined to ensure contact between the coupler 1500 and the clasp 1012.

The coupler 1500 may include a first hook 1510 surrounding one side of the clasp 1012 and a second hook 1520 surrounding the other side of the clasp 1012. More specifically, the first hook 1510 may be positioned to surround one side of the guide pin 1016 and the second hook 1520 may be positioned to surround the other side of the guide pin 1016.

The coupler 1500 includes a first housing 1502 installed to the container 100. In this case, a plurality of components may be installed to the first housing 1502 to come into contact with the clasp 1012 so as to be coupled to or released from the clasp 1012.

The first housing 1502 is fixed to one surface of the container 100. That is, the first housing 1502 protrudes from only one surface of the container 100 rather than penetrating the container 100.

The first hook 1510 and the second hook 1520 are installed to the first housing 1502.

The first hook 1510 is fixed to the first housing 1502. That is, the first hook 1510 remains stationary at a predetermined position relative to the first housing 1502 regardless of whether or not external force is applied to the coupler 1500.

The first hook 1510 may have a first seat surface 1512 that substantially comes into contact with the guide pin 1016. The first seat surface 1512 may be formed of a shock absorbing material to prevent breakage thereof or to endure shock caused by frequent contact with the guide pin 1016.

The first hook 1510 may be coupled to the first housing 1502 using a first screw 1504. In this case, the first screw 1504 may fix the first hook 1510 to prevent the first hook 1510 from being moved relative to the first housing 1502.

On the other hand, the second hook 1520 is installed to the first housing 1502 in a selectively rotatable manner.

The first housing 1502 is provided with a rotating shaft 1508 in the form of a cylindrical protrusion. The second hook 1520 has a hollow portion 1524 into which the rotating shaft 1508 may be inserted. The hollow portion 1524 has a cylindrical shape to enable rotation of the second hook 1520.

The second hook 1520 has a protrusion configured to come into contact with the guide pin 1016. Thus, the second hook 1520 may generally have a "ㄱ"-shaped or "ㄷ"-shaped form.

Meanwhile, the second hook 1520 may be coupled to the rotating shaft 1508 using a second screw 1506. In this case, the second screw 1506 may allow the second hook 1520 to be rotatable while preventing the second hook 1520 from being separated from the rotating shaft 1508.

In particular, a first elastic member 1530 is installed to elastically support the second hook 1520 such that the second hook 1520 is rotatable to surround the guide pin 1016 by a predetermined angle. The first elastic member 1530 may be a torsion spring that is elastically deformed upon receiving torque and returns to an original shape thereof upon removal of external force via elastic restoration force thereof.

The first elastic member 1530 has one end 1534 fixed to the second hook 1520 and the other end 1532 fixed to the first hook 1510. Thus, the first elastic member 1530 may limit movement of the second hook 1520. More specifically, the first elastic member 1530 may apply elastic force to the second hook 1520 to enable clockwise rotation of the second hook 1520.

Alternatively, the end 1534 of the first elastic member 1530 may be fixed to the second hook 1520 and the other end 1532 of the first elastic member 1530 may be fixed to the first housing 1502. So long as the first elastic member 1530 guides movement of the second hook 1520, the end 1534 of the first elastic member 1530 may be fixed to the second hook 1520 and the other end 1532 of the first elastic member 1530 may be coupled to any one fixed component.

Once the second hook 1520 has been rotated by a predetermined angle, the first elastic member 1530 may apply force to the second hook 1520 to return the second hook 1520 to an original state thereof. However, in a state in which the second hook 1520 is rotated beyond the predetermined angle, the first elastic member 1530 cannot apply force to the second hook 1520 to return the second hook 1520 to an original state thereof. More specifically, the first elastic member 1530 applies elastic restoration force to enable clockwise rotation of the second hook 1520 once the second hook 1520 has been rotated by a predetermined angle, but cannot apply elastic restoration force to the second hook 1520 after the second hook 1520 is rotated beyond the predetermined angle.

The second hook 1520 may have a second seat surface 1521 that substantially comes into contact with the guide pin 1016. The second seat surface 1521 may be formed of a shock absorbing material to prevent breakage thereof or to endure shock due to frequent contact with the guide pin 1016.

Meanwhile, the second hook 1520 substantially does not come into contact with the door 20 because the second hook 1520 is located at one surface of the container 100. That is, the second hook 1520 may be operated while not coming into contact with the door 20.

FIG. 26 is a view showing operation of the fixing device in the state of FIG. 1 according to one embodiment. A description with reference to FIG. 26 is as follows.

When the door 20 hermetically seals the first storage region 2 as exemplarily shown in FIG. 1, the container 100 is positioned as exemplarily shown in FIG. 2. In this case, the container 100 is completely covered with the door 20 and is invisible in the state of FIG. 1. In addition, the container 100 and the door 20 come into contact with each other.

The coupler 1500 is coupled to the clasp 1012. In this case, the guide pin 1016 is surrounded by the first hook 1510 and the second hook 1520.

In such a state, the container 100 may be fixed to the cabinet 10. In addition, as the door 20 comes into contact with the container 100 and prevents movement of the container 100, rotation of the container 100 is impossible.

However, the second hook 1520 may be rotated when force required to overcome elastic force of the first elastic member 1530 is applied to the second hook 1520.

FIG. 27 is a view showing operation of the fixing device in the state of FIG. 2 according to one embodiment. A description with reference to FIG. 27 is as follows.

Meanwhile, the user may rotate the door 20 alone as exemplarily shown in FIG. 2 to access the container 100 through the front of the container 100 or to access food stored inside the door 20. In this case, the container 100 remains fixed to the cabinet 10.

In this case, the user may use the above-described fastening device 1600.

When the user opens the door 20 alone, the second hook 1520 remains in a fixed state rather than being rotated. This is because the door 20 and the container 100 are not coupled to each other and, thus, the door 20 cannot apply force to the container 100 so as to rotate the container 100 downward. That is, the container 100 may be fixed to the cabinet 10 because the guide pin 1016 is surrounded by the first hook 1510 and the second hook 1520.

In conclusion, when the user rotates the door 20 alone by the fastening device 1600 in the state of FIG. 26, the coupler 1500 couples the container 100 to the cabinet 10. In this way, the container 100 may be continuously coupled to the cabinet 10 in a pivotally rotated state of the door 20.

FIG. 28 is a view showing operation of the fixing device in the state of FIG. 3 according to one embodiment. A description with reference to FIG. 28 is as follows.

The user may simultaneously rotate the container 100 and the door 20 as exemplarily shown in FIG. 3.

In this case, in the state shown in FIG. 26, the door 20 and the container 100 are rotated together. This is because the door 20 and the container 100 are rotated together relative to the cabinet 10 by the first hinge member 40 while maintaining a distance therebetween. To simultaneously rotate the door 20 and the container 100, the user may operate the fastening device 1600 in the above-described manner.

In the state of FIG. 26, the coupler 1500 couples the container 100 and the cabinet 10 to each other with slight force. That is, when the user applies force beyond torque of the first elastic member 1530 to the door 20 and the container 100, the second hook 1520 may be rotated.

In this case, the second hook 1520 may be rotated counterclockwise as the door 20 and the container 100 are moved downward because the guide pin 1016 is integrated with the cabinet 10 and remains stationary. In this case, the second hook 1520 comes into contact with the guide pin 1016 and is sufficiently rotated counterclockwise by the guide pin 1016. In particular, once the second hook 1520 is sufficiently rotated, the second hook 1520 no longer comes into contact with the guide pin 1016.

That is, the coupler 1500 is not fixed to the guide pin 1016 and, therefore, the user can access food stored in the first storage region 2 by rotating the container 100 and the door 20 together relative to the cabinet 10.

The user must rotate the door 20 and the container 100 to the state shown in FIG. 1 after retrieving food stored in the first storage region 2 or inserting food into the first storage region 2.

In this case, the second hook 1520 remains in a counterclockwise rotated state. This is because the first elastic member 1530 cannot apply elastic restoration force to the second hook 1520 once the second hook 1520 is rotated by a predetermined angle. As the first elastic member 1530 does not provide elastic restoration force, the second hook 1520 is rotated counterclockwise and remains stationary.

When the user rotates the door 20 and the container 100 inward of the first storage region 2, the second hook 1520 comes into contact with the curved surface 1015 of the guide wall 1014. In this case, as the user gradually rotates the container 100 upward, the second hook 1520 successively comes into contact with different portions of the curved surface 1015. As the second hook 1520 comes into contact with the curved surface 1015, the second hook 1520 may be rotated clockwise and be positioned as exemplarily shown in FIG. 26.

In particular, when the second hook 1520 comes into contact with the curved surface 1015 for a predetermined time and is rotated clockwise by a predetermined angle or more, the second hook 1520 may be easily rotated clockwise by elastic restoration force of the first elastic member 1530.

Of course, when force required to overcome elastic support force of the first elastic member 1530 is applied in the state of FIG. 28, the second hook 1520 cannot be rotated and, therefore, the coupler 1500 may be released from the clasp 1012.

The present invention should not be construed as limited to the embodiments set forth herein. It should be understood that various modifications can be made by those skilled in the art within the spirit and scope of the invention as defined by the claims and these modifications should not be understood independently of the technical sprit or prospect of the invention.

MODE FOR THE INVENTION

As described above, a related description has sufficiently been discussed in the above "Best Mode" for implementation of the present invention.

INDUSTRIAL APPLICABILITY

As described above, the present invention may be wholly or partially applied to a refrigerator.

The invention claimed is:

1. A refrigerator comprising:

a cabinet defining a first storage region configured to store food;

a door rotatably connected to a first rotating shaft via a first hinge member to open or close the first storage region, the first rotating shaft provided at a front of the cabinet;

a gasket provided at the door;

a container defining a second storage region, the container configured to be received in the first storage region of the cabinet and rotatably connected to a second rotating shaft via a second hinge member that is provided at the door and that is fixed to the container;

a handle provided at a front surface of the door, the front surface of the door facing away from the first storage region;

a coupler configured to selectively couple the container to the cabinet;

a latch member provided at the container; and a fastening device provided at the door, the latch member being configured to catch the fastening device to selectively couple the door with the container, wherein the fastening device comprises:

a seal configured to block outward movement of cold air through the fastening device in a state in which the door is coupled with the container; and an operating unit located on the handle and exposed to a user to be pushed by the user.

2. The refrigerator according to claim 1, wherein the seal is configured to block an outward flow of cold air through a path in the fastening device.

3. The refrigerator according to claim 2, wherein the fastening device is provided in a region of the door that is surrounded by the gasket and that is communicative with the first storage region.

4. The refrigerator according to claim 3, wherein the fastening device further comprises a hook, the latch member being configured to catch the hook, wherein the hook is configured to pivotally rotate between a first position in which the hook is caught by the latch member and a second position in which the hook is released from the latch member.

5. The refrigerator according to claim 4, wherein the fastening device comprises:

a lever provided at the operating unit and configured to be pushed by the user; and a first link and a second link that are configured to transfer a displacement generated by the lever, wherein the second link is configured to pivotally rotate the hook based on the displacement generated by the lever.

6. The refrigerator according to claim 5, wherein the first link is separable from the second link.

7. The refrigerator according to claim 5, further comprising a first housing comprising a first bore through which the first link is inserted, the first bore configured to guide a longitudinal movement of the first link, wherein a cross-sectional area of the first bore is the same as a cross-sectional area of the first link.

8. The refrigerator according to claim 5, further comprising a second housing comprising a second bore through which the second link is inserted, the second bore configured to guide a longitudinal movement of the second link, wherein a cross-sectional area of the second bore is the same as the cross-sectional area of the second link.

9. The refrigerator according to claim 8, wherein the seal is provided at one end of the hook, and wherein the seal is configured to selectively hermetically seal an opening at one end of the second bore.

10. The refrigerator according to claim 5, wherein a longitudinal movement direction of the first link is perpendicular to a longitudinal movement direction of the second link.

11. The refrigerator according to claim 2, wherein the fastening device comprises:

an amplifier member configured to amplify a first displacement generated by a user; and a transfer member configured to transfer, to the latch member, a second displacement generated by the amplifier member based on the first displacement generated by the user.

12. The refrigerator according to claim 11, wherein the amplifier member comprises:

a pivot bar configured to be rotated about a rotating shaft based on a force applied to the pivot bar by the first displacement generated by the user; and a link bar provided at one end of the pivot bar and configured to be moved longitudinally by a pivotal rotation of the pivot bar.

13. The refrigerator according to claim 12, wherein the seal is provided at the pivot bar and configured to hermetically seal a communication hole in the fastening device based on a removal of the force applied to the pivot bar by the first displacement generated by the user.

14. The refrigerator according to claim 12, wherein the transfer member comprises:

a transfer member housing in which one end of the link bar is received; and a release pin configured to be moved based on the longitudinal movement of the link bar.

15. The refrigerator according to claim 14, wherein the seal is provided at the release pin and is configured to hermetically seal, based on a removal of a force applied to the release pin by the longitudinal movement of the link bar, a through-hole through which the link penetrates.

16. The refrigerator according to claim 1, wherein the door comprises an elastic protrusion configured to protrude toward the container, and wherein the elastic protrusion is configured to be compressed based on the door being coupled to the container.

17. The refrigerator according to claim 1, further comprising a handle provided at a side surface of the door.

18. The refrigerator according to claim 1, further comprising a fixing device provided at the container and configured to selectively couple the container to the cabinet, the fixing device comprising the coupler.

19. The refrigerator according to claim 18, wherein:

in a state in which the fixing device couples the container to the cabinet, the door is configured to rotate relative to the cabinet via the first hinge member and rotate relative to the container via the second hinge member, and in a state in which the fastening device couples the container to the door, the door and the container are configured to simultaneously rotate relative to the cabinet via the first hinge member.

20. The refrigerator according to claim 18, wherein:

in a state in which the fastening device couples the container to the door, the fixing device is configured to release a coupling between the container and the cabinet based on the door being rotated to open the first storage region.

21. The refrigerator according to claim 18, wherein:

in a state in which the fastening device decouples the container from the door, the fixing device is configured to couple the container to the cabinet based on the door being rotated to open the second storage region.

* * * * *